United States Patent [19]

Wilson et al.

[11] 4,280,430

[45] Jul. 28, 1981

[54] LINKED-SPAR MOTION-COMPENSATED LIFTING SYSTEM

[75] Inventors: Jeffrey V. Wilson; William D. Briggs, both of Camarillo, Calif.

[73] Assignee: The United States of America as represented by the Secretary of the Navy, Washington, D.C.

[21] Appl. No.: 6,825

[22] Filed: Jan. 26, 1979

[51] Int. Cl.[3] ..... B63C 7/00

[52] U.S. Cl. ..... 114/51; 9/8 R; 9/8 P; 212/146

[58] Field of Search ..... 212/8 R, 8 B, 3 R, 3 A, 212/190–194; 9/8 R, 8 P; 114/50, 51, 230; 294/111, 112

[56] References Cited

U.S. PATENT DOCUMENTS

| | | | |
|---|---|---|---|
| 3,782,458 | 1/1974 | Slack | 9/8 R |
| 3,912,088 | 10/1975 | Bronfman | 212/8 B |
| 3,950,806 | 4/1976 | Puchois | 114/230 |
| 4,010,500 | 3/1977 | Reid | 9/8 P |
| 4,088,089 | 5/1978 | Flory | 9/8 P |
| 4,150,636 | 4/1979 | Lundh | 9/8 P |
| 4,173,804 | 11/1979 | Duc | 9/8 P |

*Primary Examiner*—Trygve M. Blix
*Assistant Examiner*—D. W. Keen
*Attorney, Agent, or Firm*—Richard S. Sciascia; Joseph M. St. Amand; Wm. C. Daubenspeck

[57] ABSTRACT

A system for operating a lifting cable over the side of a ship at sea in which a spar buoy having an adjustable lifting capacity is coupled to the ship by a rigid linkage which is free to pivot on an axis attached to the deck. The lifting cable is suspended from a first sheave which is mounted above a central, longitudinal channel in the spar buoy. The linkage is attached to the top of the spar buoy such that the spar buoy may rotate about an axis normal to the deck axis of the linkage and pivot on an axis normal to the longitudinal axis of the spar buoy. A second sheave is mounted on the deck axis so that the distance between the sheaves does not change as the linkage rotates on its axis. The lifting cable is fed from a winch on the ship over the sheaves and falls through the longitudinal channel. The invention operates to decouple the motion of the ship from the lifting cable so that the vertical motion of the cable is controlled by the motion of the spar buoy. A topping lift technique for deck-handling the system and an emergency disconnect feature are also disclosed.

17 Claims, 8 Drawing Figures

Fig. 1. LINKED SPAR

LINKED-SPAR MOTION-COMPENSATED LIFTING SYSTEM

BACKGROUND OF THE INVENTION

This invention relates generally to the handling of objects over the side of a ship at sea and, more particularly, to a deck handling system in which the motion of a surface support ship is isolated from a payload suspended in the ocean by a lifting cable.

The handling of objects over the side of the ship at sea is historically a difficult problem. The motion of the ship can induce large dynamic loads on the lift line and parting of lines during operations such as salvage recovery, undersea work vehicle operations and even basic moorings is not uncommon. Deck handling systems having active or passive motion compensation have been built but these have always involved great expense and usually provided poor reliability. The devices are very complicated mechanically and require a major modification to the ship to provide proper footings for them. They usually include a motion-damped over-the-side boom with the lift line winch or at least a traction unit mounted directly on the device, which must swivel and be capable of locking to allow handling the load over the side. By their nature they have very close, definite limits on their vertical travel. They are essentially fixed installations on the ship and are not easily disassembled for transfer to other vessels or for air shipment to various parts of the world. A similar technology exists in the many motion-compensation and tension-limiting systems used by the oil industry for drill strings, but these systems are not directly applicable to over-the-side handling.

SUMMARY OF THE INVENTION

As requirements of deep ocean work press for increased vehicle size, heavier/larger cables, and more sophisticated deep ocean salvage, it becomes necessary to have a simple, rugged system applicable to a variety of tasks which will not only operate in sea states up to 4 or 5 but which has a capability to support the object and to survive temporary excursions past these limits without catastrophic results.

It is, therefore, an object of the present invention to isolate the motion of a surface support vessel from a payload suspended in the ocean by a lifting cable.

Another object of the present invention is to provide an over-the-side lifting system which reduces unwanted vertical displacements and vertical velocities in the suspended payload.

A further object of the present invention is to provide an over-the-side handling system which reduces unwanted accelerations in the suspended cable and load, and reduces dynamic tension in the cable and at the terminations.

Another object of the present invention is to provide a motion-compensating lifting system which requires a minimum of deck space on the support vessel and minimal modification to the vessel so that a great variety of vessels can use the system.

Yet another object of the present invention is to provide a simple means of handling a payload from the deck of a ship into the water and back again.

A further object of the present invention is to provide an inherently stable system to support a payload just below the surface during any operation to be performed prior to lowering or after recovering the payload before it is brought aboard or otherwise transferred for shipping.

Still another object of the present invention is to provide a motion-compensating system which automatically adjusts for the deviation of the lift line from the vertical whenever there is lateral drag on the cable and suspended payload due to ocean current, or lateral motion of the surface vessel or payload.

Another object of the present invention is to provide a lifting/deck handling system which is modular in nature so that by changing only a few simple elements the system can accommodate a variety of payload sizes, lift line sizes and overall ship configurations.

In the linked-spar system of the present invention a payload is suspended by a lifting cable passing over a first sheave which is mounted in a yoke on the top of a spar buoy (spar). The spar has a central longitudinal channel allowing the lifting cable to pass through a thin, water-surface-penetrating upper section and a large, submerged base section. The lifting capacity of the spar is adjustble so that only the upper section penetrates the water's surface and the base section remains submerged as the load which must be supported varies. The yoke is free to pivot on an axis normal to the longitudinal channel. A rigid, A-shaped frame has the apex coupled to the yoke and the other ends hinged on an axis (deck axis) attached to the deck of a surface support vessel, allowing the frame to rotate relative to the vessel. The frame is joined to the yoke by a connection which allows the yoke to rotate about an axis normal to the deck axis. A second sheave of the same diameter and substantially aligned with the first sheave is mounted with its center of rotation on the deck axis of the rigid frame so that the distance between the first and second sheaves remains constant as the frame rotates on the deck axis. The lifting cable is fed from a winch located on the vessel to a position below the second sheave. The cable is then fed over the second sheave and over the first sheave which is mounted so that the lifting cable then falls into the longitudinal channel. The foregoing arrangement decouples vessel's pitch and roll from the lifting cable with the result that the vertical motion of the lifting cable other than that due to the intake and outtake of the cable is controlled exclusively by the motion of the spar which is itself highly decoupled from the motion of surface waves.

The linked-spar system may be deck-handled using topping lift techniques. Topping lift lines, attached to the apex of the rigid frame, are used to rotate the frame (with the spar or spar and load attached) on its deck-mounted axis to be stored in a substantially upright position on the deck prior to or following deployment.

Other advantages and features of the present invention will be readily appreciated as the subject invention becomes better understood by reference to the following detailed description, when considered in conjunction with the accompanying drawing wherein:

BRIEF DESCRIPTION OF THE DRAWING

FIG. 1 is a pictorial view illustrating an embodiment of the linked-spar lifting system;

DESCRIPTION OF A PREFERRED EMBODIMENT

Figure 2:
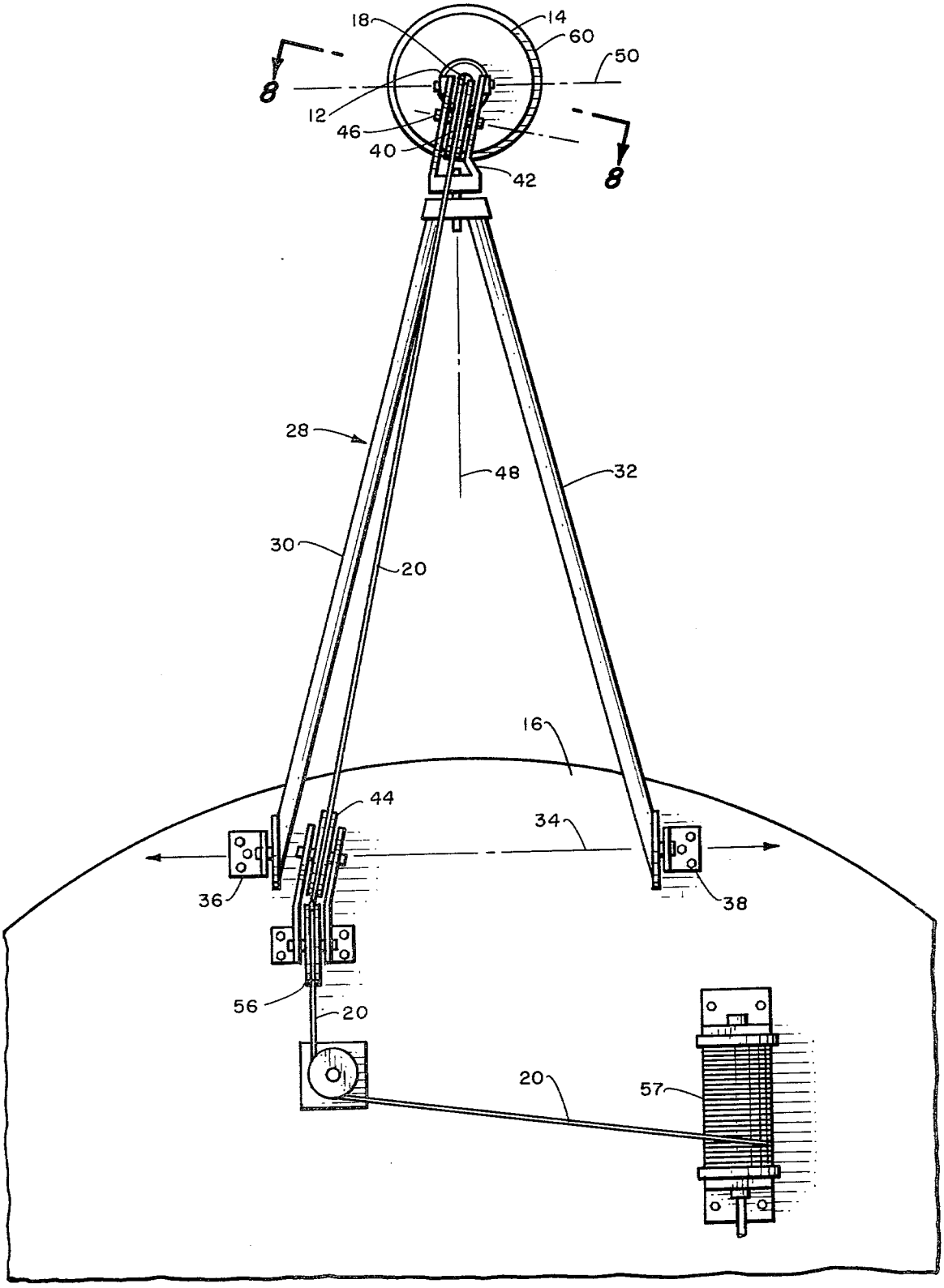
FIG. 2 is a top plan view of the linked-spar lifting system of FIG. 1.
Figure 3:
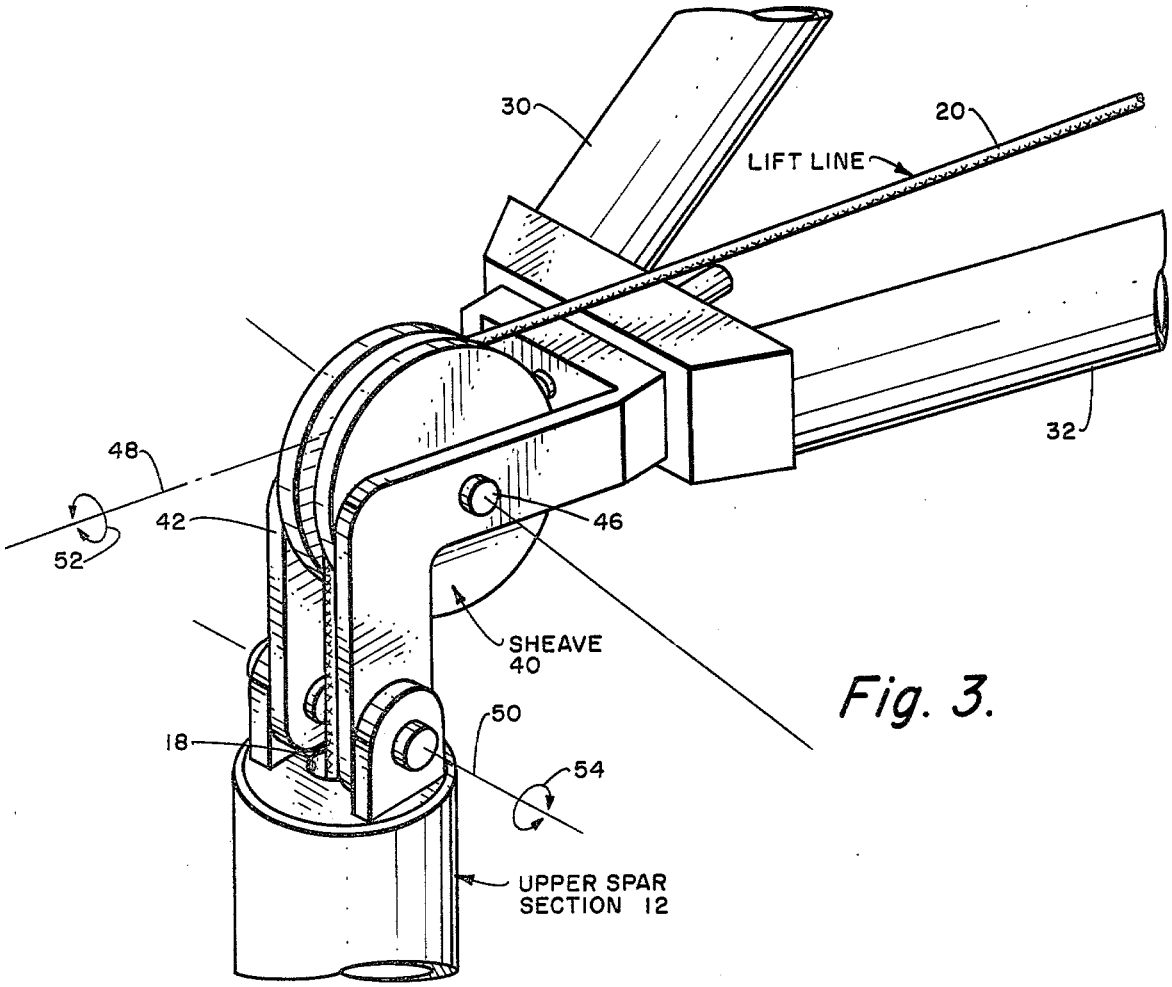
FIG. 3 is an enlarged pictorial view of the region indicated by line 3—3' in FIG. 1 illustrating the coupling of the linkage system to the spar buoy.

Referring now to the drawings, wherein like reference characters designate like or corresponding parts throughout the several views and, more particularly to FIGS. 1–3, a spar buoy (spar) 10 having a hollow upper section 12 of relatively small cross-sectional area and a hollow base section 14 of relatively large cross-sectional area is shown deployed over the stern of a surface support vessel such as an offshore work boat 16. The spar 10 has a centrally located, longitudinal, free-flooded channel 18 (best shown in the cross-sectional view of the spar in FIG. 4) that allows passage of a primary lifting cable (lift line) 20 through both the upper section 12 and the base section 14. The lifting cable 20 exits the bottom section 14 through a flared flexural strain relief 22 (see FIG. 4). A payload 24 is attached to the lifting cable 20 and supported by the buoyancy of the spar 10.

The spar 10 and the lifting cable 20 are connected to the support vessel 16 by a linkage system which includes a frame 28 comprising two rigid arms 30 and 32, which are rigidly joined to each other at one end (referred to herein as the apex end) and which are hinged at the other ends on a common axis 34 attached to the deck of the vessel 16 at frame mounts 36 and 38. The arms 30 and 32 of the frame 28, which is designed to sustain primarily compression loads, may conveniently be of aluminum or steel pipe as shown in the drawing; however, it is noted that many other structural designs such as open trussworks and many materials are suitable for the frame. The frame 28 is hinged to the deck of the vessel at any selected position, preferably with the axis 34 at about the same height above the mean water line 37 as the top of the spar and near enough the deck edge to allow full motion of the frame 28 on axis 34 without interference from the deck. The frame 28 may be attached to the ship either over the side, preferably amidships, or off the stern, as shown in FIG. 1, depending on the application. The frame 28 thus formed is internally rigid and, relative to the vessel 16, free to rotate only about the common axis 34.

As best shown in the enlarged view of FIG. 3, sheave (spar sheave) 40 of diameter d is mounted in a yoke 42 at the rigid outboard end (apex end) of the frame 28 and is oriented to be substantially aligned with a second sheave 44 (not shown in FIG. 3) which is mounted on the deck. The spar sheave 40, which is free to rotate about its axle 46, is positioned above the spar 10 such that a lifting cable passing over it will fall through the longitudinal channel 18. The yoke 42 is attached at one end to the apex of the frame by a rotational connection allowing it to rotate on axis 48 and attached at the other end to the top section 12 of the spar 10 by a pivotable connection allowing it to pivot on axis 50. The yoke 42 is thereby free to rotate in a direction parallel to the common axis 34 of the frame and also pivot in a direction parallel to the longitudinal axis of the spar as indicated by arrows 52 and 54, respectively.

Thus, the linkage system forms a triangle which is nominally horizontal during operations and is constrained to translate laterally with the vessel 16. In addition, the linkage decouples the vessel's roll and pitch from the spar 10 through rotation of the linkage about the common axis 34 and the gimbal-like coupling between the frame 28 and the spar 10. The linkage system should be long enough to ensure that the ship's motion does not interact with the spar. In general, a suitable length is about two to three times the maximum vertical motion of the vessel 16 at the place of attachment. Thus, the minimum required length varies according to the type of support vessel.

The second sheave (deck sheave) 44 has the same diameter d as the spar sheave 40 and is disposed between frame mounts 36 and 38, preferrably near one of the arms such as near arm 30 as shown in FIGS. 1 and 2. The spar sheave 40 and the deck sheave 44 are substantially alinged so that a lifting cable 20 may pass over both of them without causing undue chaffing on the sides of the sheaves. This location near an arm facilitates the deck handling features of the system and launch-/recovery of the spar from on the deck as will become apparent during the description of the deck handling features of the invention in connection with FIG. 7. The deck sheave 44 is directed toward the apex of the frame 28 and has its center of rotation on the linkage axis of rotation 34. A person skilled in the art will recognize that sheave 44 may be disposed anywhere between the frame mounts as long as the center of rotation is on axis 34 and it is in substantial alignment with the spar sheave 40. If deck handling is not desired, both sheaves 40 and 44 may preferrably be aligned along axis 48 so that the lifting cable 20 will approximately bisect the angle formed by arms 30 and 32. This simplifies the design of the frame 28 since the load will be equally distributed between the two arms. The design of the yoke 42 to allow alignment of the sheaves is also simplified.

Figure 4:
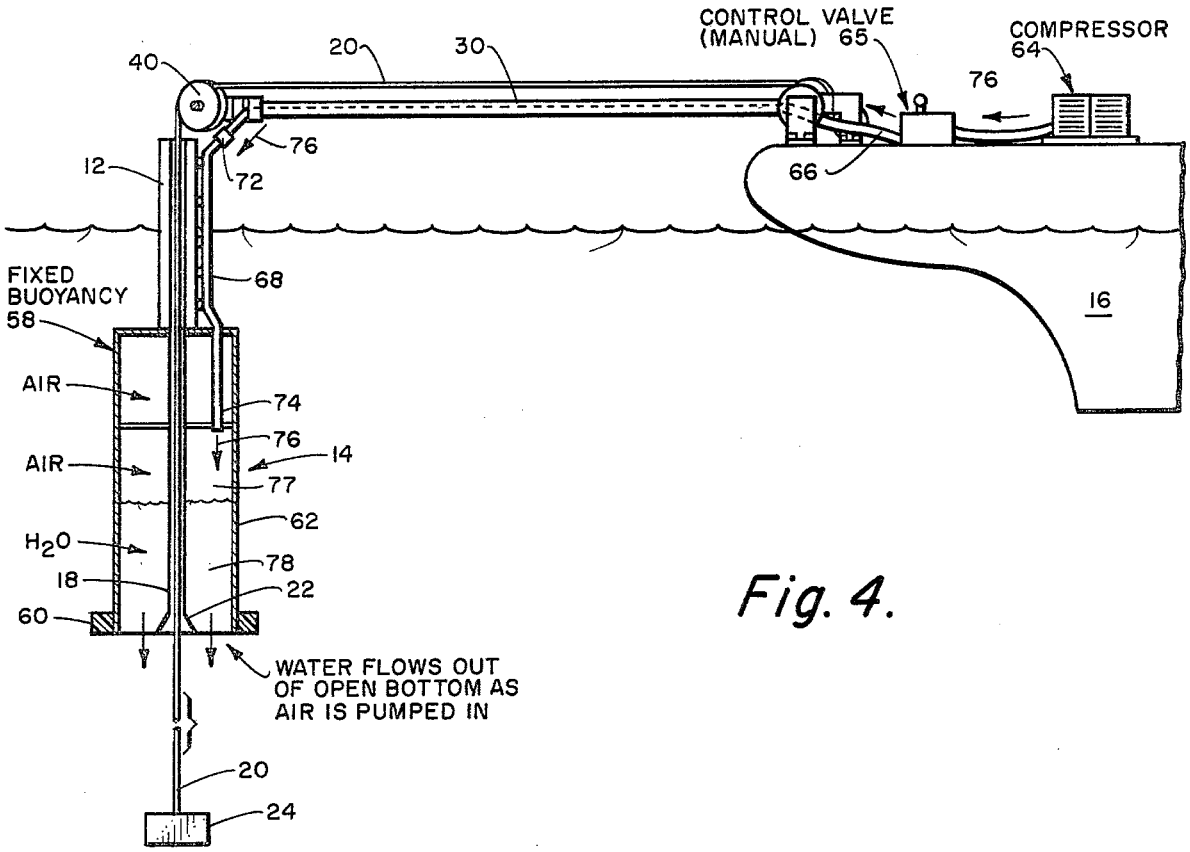
FIG. 4 is a side view of an embodiment of the present invention in which the spar buoy is shown in cross section.

A third sheave 56 is disposed below and behind the deck sheave 44 (as best shown in FIG. 4). It will be recognized that sheave 56 is not required to be in precise alignment with sheave 44 and may be used to orient the lifting cable in a different direction than that established by sheaves 40 and 44. The lifting cable 20 is coupled from a main winch 57, shown mounted on the deck but which may be mounted in any suitable location such as below deck if desired, to the third sheave 56. In general, additional sheaves will be required to fair lead the lifting cable from the winch 57 to the third sheave 56. The lifting cable 20 passes under the third sheave 56 and then over deck sheave 44 and over the spar sheave 40 to the longitudinal channel 18. The third sheave 56 ensures that the length of the cable which is wrapped around the inboard side of the deck sheave 44 does not change due to rotation of the linkage in response to motions of the spar and vessel.

Since, as is well known, the resonant period of a spar buoy's vertical motion is inversely proportional to the cross-sectional area penetrating the surface and proportional to the square root of the spar's in-air weight, the length of the upper section 12 is chosen in view of the maximum sea state in which the spar is intended to operate; the upper section 12 is long enough to prevent the lower section from penetrating the ocean surface due to the vertical displacement of the surface and of the spar itself due to the wave motion (although the latter is relatively small). In general, the cross-sectional area of the upper section 12 is chosen to provide as long a resonant period as possible while at the same time providing sufficient structural strength to support the loads applied horizontally and vertically through the linkage. The cross-sectional shape of the spar 10 (both sections 12 and 14) is optional, although a circular cross-section is preferred for most operations because of the symmetry and ease of fabrication. In view of the low pressure differentials which will be experienced by the spar 10, various cross-sectional shapes are possible, such as a square cross section for improved packaging during shipping and easier deck handling, or a faired cross-section for improved towing capabilities. Since the base section 14 does not penetrate the water's surface during deployment, the design of this section is quite flexible. The size and shape of section 14 is primarily determined by the intended payload of the system. The base section 14 must provide sufficient lift capacity for the intended payload and length (weight) of cable required. It is desirable to fabricate the upper section 12 (surface penetrating section) of the spar as a sealed unit separate from the base section 14 and combine the two sections when ready for deployment. This would greatly reduce the size during shipping and would allow the use of a variety of base sections (the main lifting section) with just one upper section to improve modularity and flexibility of the system.

Since the effective weight which the spar must support will vary, the lift capacity of the spar 10 is adjustable to allow the spar to float with the mean water line 39 at approximately the middle of the upper section 12. For example, the proper floatation level must normally be maintained when the spar is supporting only its own weight and also when it is supporting a load (such as the linkage, a payload, or a variable length of lifting cable). Referring now to FIG. 4, which includes a cross-sectional view of the spar, a fixed buoyancy is provided by the hollow upper section 12 and a fixed buoyancy compartment 58 at the top of the base section 14 encircling the longitudinal channel 18. These cavities are sealed to provide buoyancy to support the weight of the spar itself and the linkage. A fixed ballast 60 is disposed at the bottom of the base section 14 around the perimeter to provide righting moment to stabilize the spar 10, especially when there is no payload attached to the lifting cable 20 and the weight of the linkage system is applied to the top of the spar. The lower portion of the hollow base section 14 provides a variable ballast chamber 62 which may be watered or dewatered to provide a variable ballast for the spar. FIG. 4 illustrates a pneumatic ballast control system in which air from a shipboard compressor 64 is directed under control of control valve 65 to a first air hose 66 which passes through or along the side of the frame 28 to a second air hose 68 attached to the upper section 12 of the spar. A slack area 70 is provided in the hose path to allow for the gimbal-like motion between the frame 28 and the spar 10 and a break-away coupling 72 may be provided where the two hoses 66 and 68 are joined. The compressed air then passes via hose 68 through the fixed buoyancy compartment 58 and enters the top of variable ballast chaamber 62 at air inlet/outlet 74. When it is desired to increase lift capacity, the compressed air is allowed to flow in the direction of arrows 76 to dewater chamber 62 by forcing water out of the bottom of the chmber, thereby creating an upper section 76 containing air and lower section 78 filled with water. Alternatively, when it is desired to reduce lift capacity, the air line is vented at the control valve 65 and sea pressure forces water into the bottom of the spar and air out via the hoses 66 and 68.

It is noted that numerous other techniques may be used to control the watering/dewatering of the spar. For example, a small pump under electrical control from an umbilical cord which may be passed along or through the linkage may be mounted on board the spar, preferrably near the bottom of the base section 14 to promote stability, to pump the water into and out of the variable ballast chamber 62. Of course, the chamber 62 must be sealed in this case. The process of adjusting the spar's buoyancy to compensate for increased weight as cable is paid out or to tune the spar's resonant period may easily be automated. A simple variable resistance probe or series of probes of the type commonly used to monitor liquid levels may be mounted in the longitudinal-free-flow channel 18 of the spar to determine the exact spar displacement, even in reduced surface visibility. The information from the water level sensor would then be transmitted via an umbilical cord (passing along the linkage) to a control unit located on the vessel. The control unit would then automatically operate the watering/dewatering system to increase or decrease the spar's displacement to maintain the mean water line at the desired point (usually the midpoint) of the upper section 12.

Figure 5:
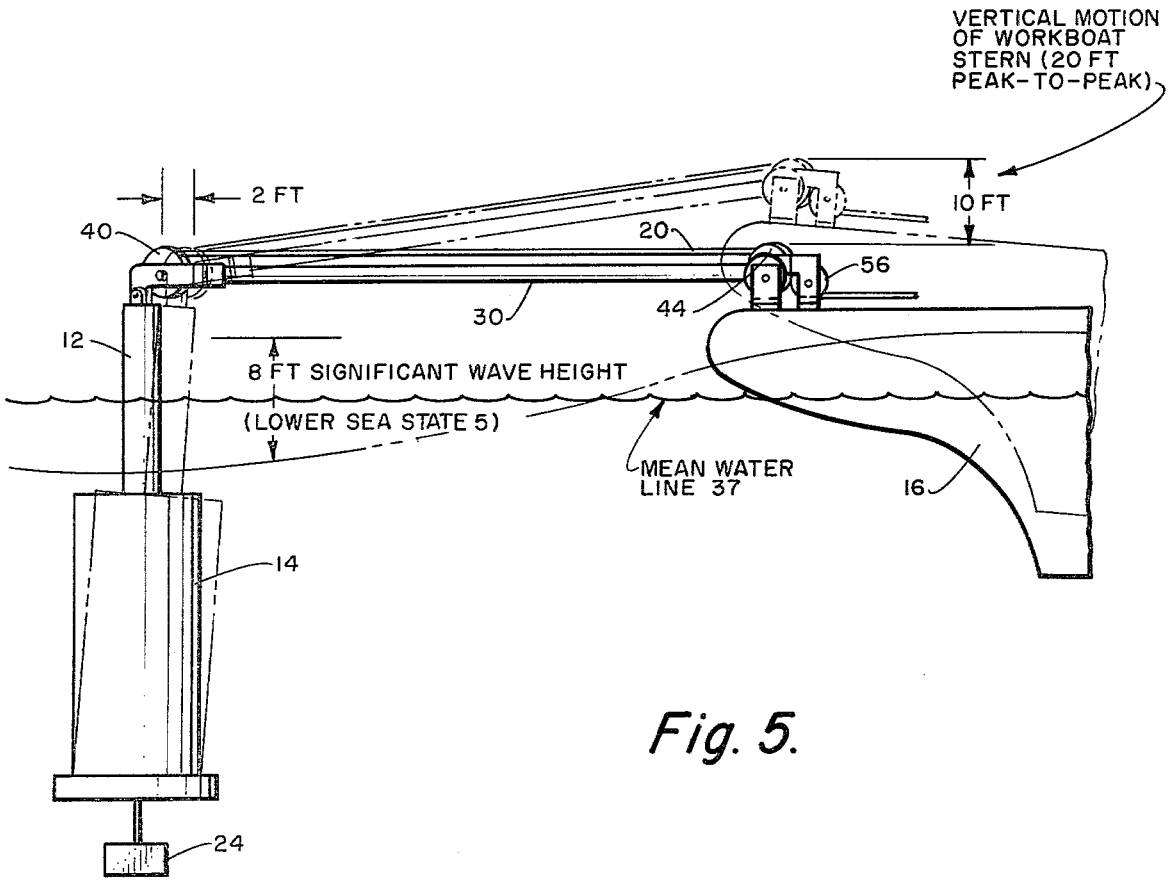
FIG. 5 is a pictorial view illustrating the decoupling of the spar buoy from the motion of the support ship.

The following description is directed to the operation of the linked spar system as an over-the-side handling system having passive motion compensation. Referring now to FIG. 5, a linked spar system supporting a payload 24 is shown deployed over the stern of an off-shore work boat 16. The lift capacity of the spar is adjusted through use of the deballasting system so that the spar floats with the mean water line 39 being approximately at the midpoint of the upper section 12 as shown. For a significant range of sea state frequencies, the spar 10 is inherently decoupled from the surface wave action, the natural period of sapr being related to the cross-sectional area of upper section and the spar's in-air weight as previously noted. Consider, for example, a spar buoy having a cylindrical upper section 12 two feet in diameter and twenty feet in length and a base section 14 which is seven feet in diameter and twenty feet in length. A spar of this size, which would have a lift capability of about 40,000 pounds (enough to recover a 10,000 pound object by a lift line in 20,000 feet of water), has a vertical resonant motion period of approximately 20 to 30 seconds depending primarily on the spar's in-air weight, and a typical maximum vertical excursion in conditions up to Sea State 5 of less than one foot. It is therefore highly decoupled from the motion of most surface waves.

The linkage system decouples the motion of the surface support vessel 16 from the payload. The present invention utilizes the fact that two sheaves (spar sheave 40 and deck sheave 44) of the same diameter (d) and separated by a rigid frame (frame 28) will allow a line (lifting cable 20) to be passed over the sheaves so that if one is held fixed in space (spar sheave 40) and the other is moved vertically, the end of the line hanging over the fixed sheave will also remain fixed in space. In practice, the top of the spar moves only a small amount (vertically), usually less than ten percent of the wave height and probably an even smaller percentage of the actual deck motion, which also includes ship's roll and pitch.

The result is that the deck sheave 44 moves up and down relative to the spar sheave 40.

FIG. 5 illustrates the decoupling between the spar 10 (load 24) and the work boat 16, for an eight foot peak-to-peak significant wave height (lower Sea State 5) and a vertical motion of the stern of the work boat of twenty feet peak-to-peak. The solid lines represent the relative means positions of the spar and the work boat and the dashed lines represent the typical displacements from the mean positions. Note that as the deck sheave 56 rises (from the wave motion and ship's pitch in this case) less lifting cable 20 is wrapped around the spar sheave 40, but a similar amount of lifting cable is added around the circumference of the deck hinge 44 so that at the main winch 57 (not shown) there is little or no net change in the length of cable paid out or taken in. The rotation about axis 48 decouples that ship's motion (roll in this case) which is rotational in a direction parallel to the linkage common axis 34. The pivoting on axis 50 and the rotation of the linkage about axis 34 decouple the ship's pitch. The result is that the motion of the cable 20 suspended from the sheave 40 on top of the spar 10 is controlled exclusively by the motion of the spar and is decoupled from both motion of the work boat 16 and the surface wave action.

The linked spar system does not have any mechanical limits on the motion other than those imposed by the length of the linkage itself. Most on-board motion compensation systems are limited in travel by boom length or cam length and have definite mechanical stops. Although they are designed to operate in a statistically defined sea state, the occasional random wave which is in excess of the nominal significant wave height can cause significant shock load on the system by driving it into the stops. In the present invention, however, the linkage can easily be of a length that will enable the linked spar system to survive the maximum wave which the ship is likely to survive (±30 to 40 feet). For example, a linkage of 50 feet would be an acceptable length for use with the spar of 40 feet in the system and sea state illustrated in FIG. 4.

The linked-spar system of the present invention addresses each of the four main goals of motion compensation for ocean cable handling systems. The linked-spar system reduces both the vertical displacement and the vertical velocity of the suspended load to very small values because the spar is decoupled from motion of both the support vessel and the surface. The accelerations in the suspended cable and load and the dynamic tensions in the cable and at the terminations are likewise reduced. In addition, it greatly reduces the risk of the lifting cable going slack and causing snap loading because there is no net change in the length of cable paid out or in because of relative motion between the vessel and the load.

The motion-compensationed linked-spar system provides increased capabilities by allowing a smaller lifting cable for a given load or a greater payload capacity or increased operating depth for a given cable because of the reduction in peak loads and cable wear. The system will operate in higher sea states thereby decreasing standby time, increasing the size of weather windows, increasing areas of effective work capability, improving safety and reducing overall risk. The low velocities and accelerations provide gentle handling of fragile or sensitive loads such as scientific instruments or personnel.

The adjustable ballast system provides a soft lift-off/touch-down capability offering smooth vernier control of the vertical load position over a range of a few feet (about 10 feet in the typical case). By increasing or decreasing the lift capacity of the spar, the vertical position of the spar and the suspended load may be precisely controlled. This feature reduces some of the shocks inherent in the starting and stopping of most winch-control systems. The variable lift capacity of the spar may also be used to apply a steady, slowly increasing tension for breakout of loads from the sea floor with reduced risk of snap loading since after breakout the spar will automatically assume a position of equilibrium in which the load is held above the seafloor.

Figure 6:
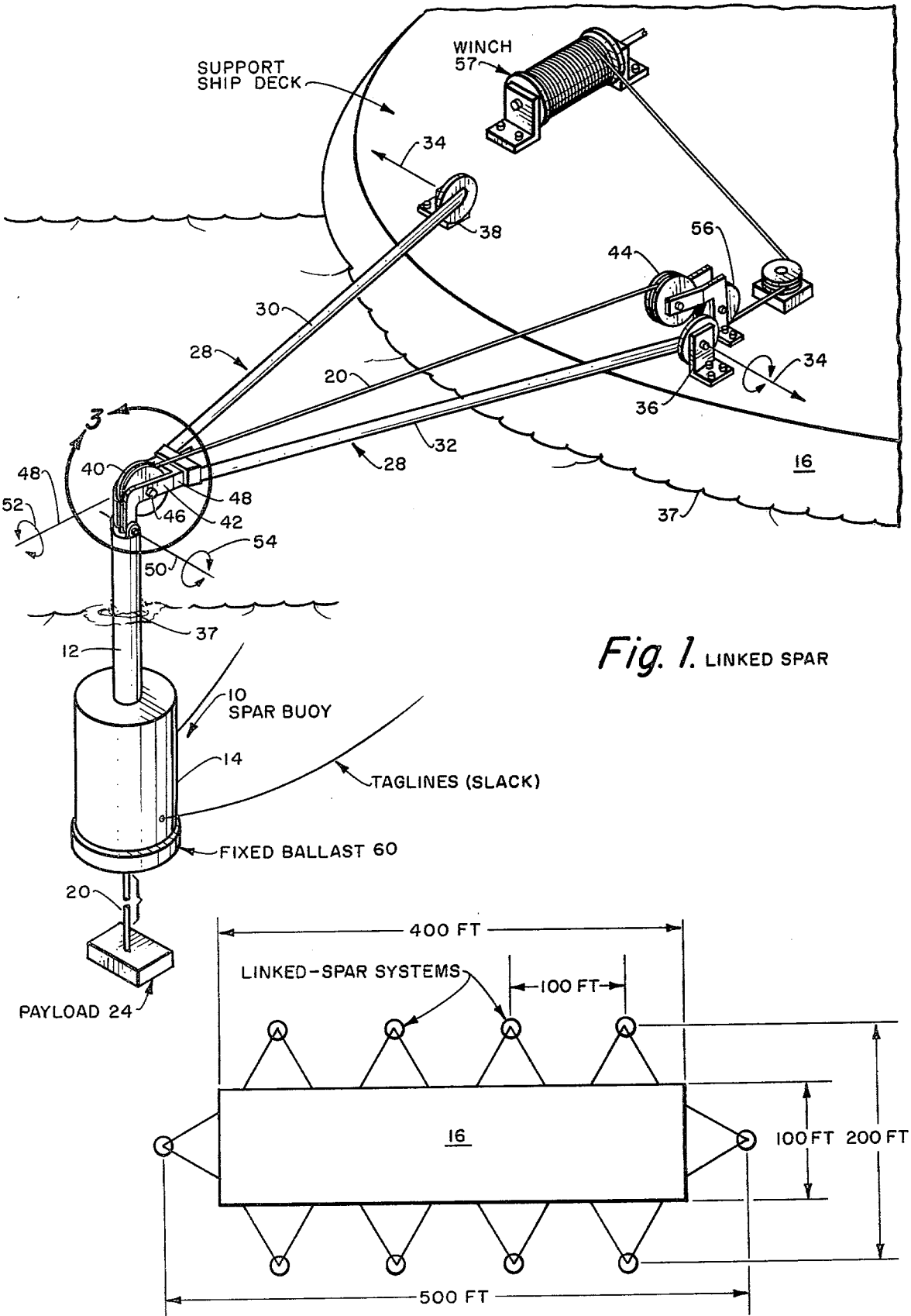
FIG. 6 illustrates that several linked-spar systems may provide a multiple-lifting-point capability.

In handling very large objects, especially in salvage, it is often true that the total weight is not as much of a problem as the lack of a single lift point on the object capable of handling the total weight. In addition, the single point lift has no redundancy; if one line fails the load is lost. Because the linked-spar system uses little deck space and because of the stand-off distance of the support ship from the actual lift point, it is possible to utilize more than one linked spar system from the same ship; such as when operating a lift line and a work vehicle at the same time, or when salvaging a very large object. FIG. 6 illustrates how as many as ten linked-spar systems having a 50 feet linkage could be operated from a 400 feet by 100 feet barge.

Figure 7:
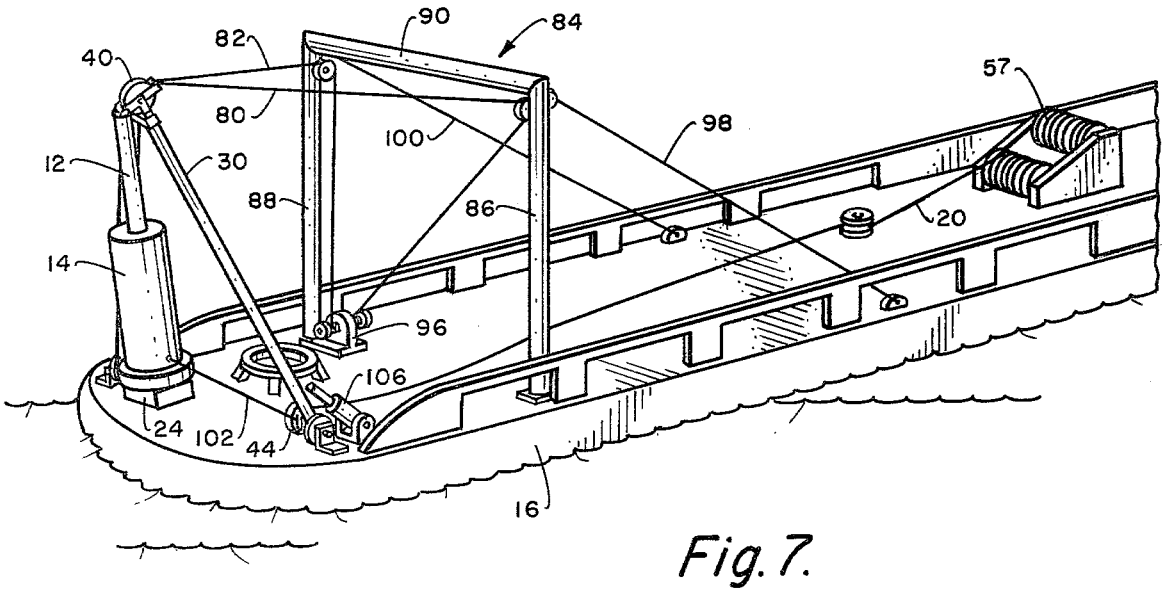
FIG. 7 is a pictorial view illustrating a technique for deck handling the linked-spar system.

If the support vessel is large enough, the linked-spar system may be launched from, recovered from, and stowed on the deck by using topping lift techniques in which the linkage serves as an A-frame. The linkage with the spar attached is pivoted about its common axis 34 and is stowed with the frame nearly vertical and with the spar (and a payload if desired) suspended from the apex. Referring to FIG. 7, a pair of topping lift lines 80 and 82, supported by a U-shaped frame 84 (including a pair of king posts 86 and 88 and a horizontal bar 90) mounted on the deck, are attached to the yoke 52. The topping lift lines are passed through suitable sheaves 92 and 94 to a deck-handling winch 96. A pair of backstays 98 and 100 provide additional support for the U-shaped frame 84. Powered tag lines 102 and 104, which serve to pull in the bottom of the spar 10 to reduce forces on the linkage and reduce pendular motion of the spar when it is not in the water, are coupled from the bottom of base section 14 to suitable sheaves (not shown) to the deck-handling winch 96. Through the use of suitable drums, topping lift lines 80 and 82 and the tag lines 102 and 104, may both be driven by the deck-handling winch 96. Hydraulic or pneumatic linkage-positioning pistons 106 and 108 are disposed to support the linkage frame 28 (and the spar) in its stowed position and also to actuate the motion of the spar/linkage during launch and to decelerate it after the linkage passes through the vertical during movement to the stowed position during recovery. When the linkage with the spar (or spar and payload) attached is in its stowed position, the frame is held secure against the supporting linkage-positioning pistons 106 and 108 by the topping lift lines 80 and 82. To deploy the system, after an initial acceleration from the positioning pistons which pivots the linkage through the vertical, the apex of the linkage with the spar attached (and stabilized by the tag lines) is lowered by the topping lift lines 80 and 82 until the spar floats. After the topping lift lines and the tag lines are either slackened or detached, the motion-compensated lifting system is ready for operation.

It is noted the foregoing launch and recovery technique places restrictions on the relative dimensions of the linkage system 26 and the spar 10. In general, the linkage should be as short as possible to reduce the structural and deck space requirements during deck handling but it should be long enough to avoid coupling between the spar 10 and the vessel during deployment. The spar should be as long as possible to promote stability when it is deployed, but must be short enough to be deck handled using the linkage as an A-frame.

In many cases, however, it may be difficult or undesirable to handle the payload over the side from the deck of the support vessel; for example, the payload may be too large or too heavy, or a covert operation may be desired. In such cases, the spar/linkage system could be attached to the vessel and left floating while in port, and then towed to sea, particularly if deployed off the stern. This alternative would be especially suitable for small support vessels or where the distance to the operating site is short. In applications where covertness is desired, the payload may be loaded beneath or even within the spar (see FIG. 9) and towed directly to or from the site without ever being handled on deck. On site, the load is already in position for lowering, with no transition from one lifting system to another being required. The speed of the tow is dictated primarily by the load configuration. Recovering can be handled the same way. Once the recovered payload is up against the buoy, it can be secured to it and towed to protected water for final transfer.

Another alternative is to carry the linkage system in place but with the spar 10 stowed either on deck, lashed to the side, towed astern separately, or in a well deck. On station, the spar is then maneuvered around to the position of the linkage and the linkage is then lowered onto the top of the spar, probably using a previously rigged messenger line to assist in the alignment of the two.

It can be seen that there is wide flexibility in the launch/recovery of the spar/linkage system and that the advantages are especially important during recovery. The fact that the spar is an inherently stable buoyancy unit makes it ideally suited for salvage operations where handling the recovered object at the surface is often the most difficult portion of the task. Once the object is lifted up against the spar it can be held there nearly indefinitely just below the surface, or towed to port in that position, or the object can be further secured to the spar by additional attachments. In an emergency such as rapidly building weather, icebergs approaching or other ship problems, the recovered payload can be secured to the spar and the spar set free at any point in the lift. The ship is then free to maneuver as required and returned to the spar at a later time. In the case of handling a vehicle, the bottom of the spar can be configured to receive the vehicle and provide a protective cage for launch and recovery of the vehicle. When the vehicle is too large for this approach, the end of the lift wire can be kept on board during spar launch and then attached to the vehicle for separate launching. Recovery would be the reverse.

Figure 8:
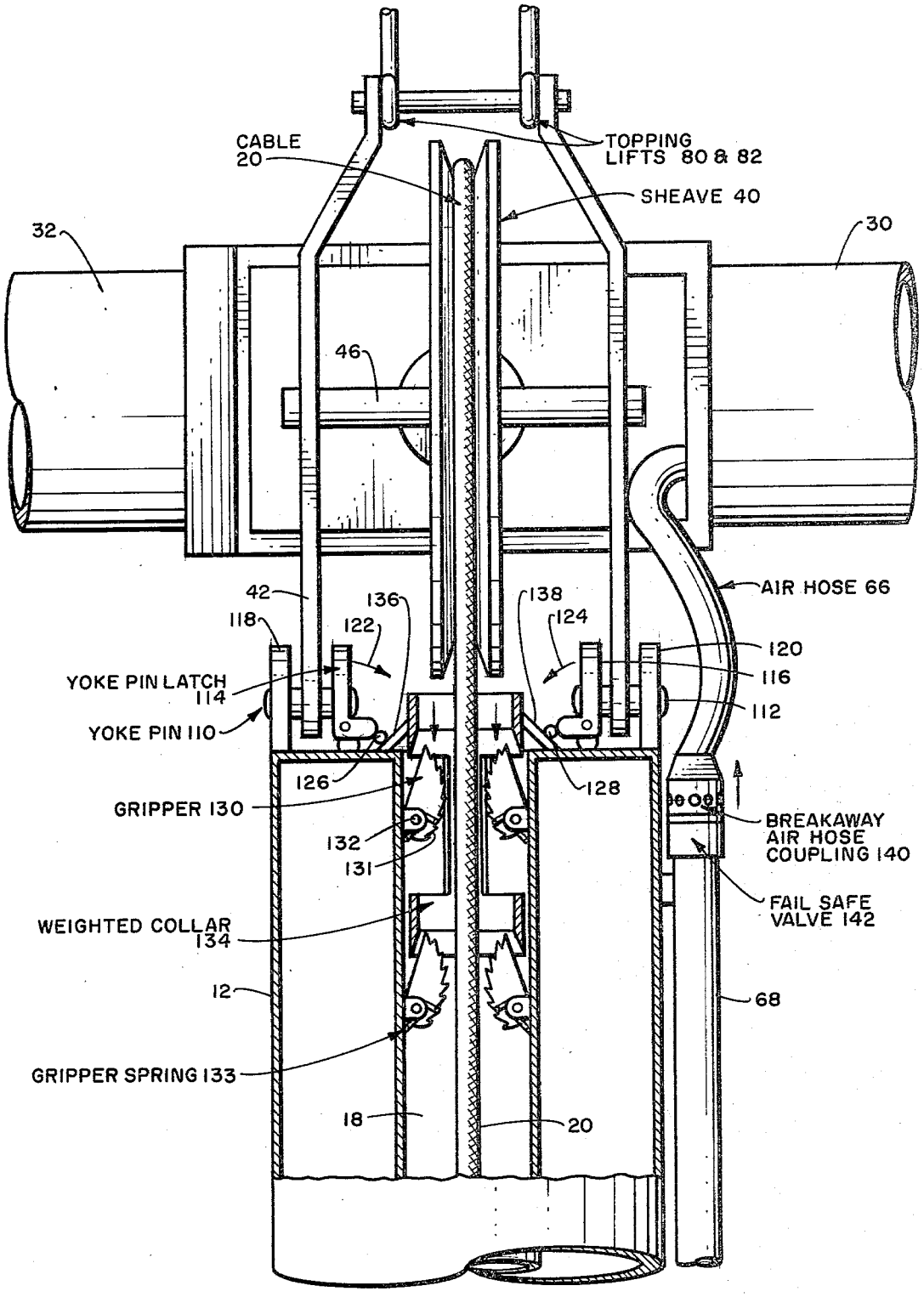
FIG. 8 is a cross-sectional view of a portion of the spar buoy and linkage illustrating an optional emergency disconnect capability.

FIG. 8 illustrates an optional emergency breakaway feature in which the yoke 42 may be disengaged from the spar 10 securing the lifting cable 20 in its present position. The yoke 42 is pivotable on pins 110 and 112 which extend between latches 114 and 115 and pin mounts 118 and 120, the latches and pin mounts being attached to the upper section 12. The latches 114 and 116, which are rotatable as indicated by arrows 122 and 124, respectively, are held in the upright position as shown by solenoid-controlled pins 126 and 128, respectively. The pins 126 and 128 may be pulled by an energizing solenoid (not shown) which is remotely controlled from the vessel. When the latches are in the upright position, yoke 42 is free to rotate about pins 110 and 112. A series of cable grippers 130, each having a toothed edge 131 and rotatable about an axis 132, are disposed in the channel 18 and are held clear of the lifting cable 20 by gripper springs 133. A weighted collar 134 is disposed longitudinally within channel 18 and held suspended by stays 136 and 138 which are held in position by the solenoid pins 126 and 128. The collar is configured so that when the loading pins 126 and 128 are in position the grippers 130 may be held clear of the cable 20 by the gripper springs 132. The grippers 130 and that portion of the collar above each of the grippers are arranged so that when the solenoid pins 126 and 128 are pulled and stays 136 and 138 no longer support the collar, the collar will fall causing the grippers 130 to engage in lifting cable 20. A breakaway coupling 140 containing a fail-safe valve 142 is used to connect the air hose 66 (attached to the ship) and the air hose 68 (attached to the spar).

In case of emergency, the yoke may be disconnected from the linkage by energizing the solenoid which pulls the solenoid control pins 126 and 128. The latches 114 and 116 then fall away, thereby releasing the yoke 42. At the same time, the collar 134 is released and falls to engage the grippers 130. After the lifting cable is cut (on the deck of the vessel in order to leave an end for retrieval) the linkage may be pulled away from the spar. The breakaway coupling 140 and the fail-safe valve 142 permit detachment of the air line and insure that sufficient lift capacity is maintained to support the spar and the payload, respectively.

Obviously, many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A lifting system for operating a lifting cable over the side of a floating platform in which the pitch and roll of the platform and the motion of the water's surface are decoupled from the lifting cable, said lifting system comprising:

a spar buoy having an upper section with a relatively small cross-sectional area and a base section of a relatively large cross-sectional area, said spar buoy having longitudinal channel for permitting passage of the lifting cable through the spar buoy;

rigid frame means having an outboard and and an inboard end, the inboard end of said frame being hinged on a first axis fixed relative to the deck of the platform to allow the frame to rotate relative to the platform;

yoke means having a first end rotatably coupled to the outboard end of said frame means to allow said yoke means to rotate about a second axis normal to the first axis, said yoke means having a second end pivotably coupled to the top of said upper section to allow said spar buoy to pivot about an axis normal to the second axis and parallel to the first axis;

first sheave means mounted on said yoke means, said first sheave means being free to rotate on its axle and positioned above said spar buoy so that a lifting cable passing over said first sheave will fall through said longitudinal channel;

second sheave means mounted on said platform, said second sheave means being free to rotate on its axle and having the same diameter as said first sheave means, said second sheave means disposed in substantial alignment with said first sheave means for the passage of the lifting cable therebetween and having its center of rotation on said first axis so that the distance between the centers of rotation of said first sheave means and said second sheave means remain fixed as said frame means rotates about the first axis;

means disposed for letting out and taking in the lifting cable, the lifting cable extending from said means for letting out or taking in over said second and first sheave means and through said longitudinal channel for connection to a payload.

2. The system as recited in claim 1 further including means for varying the lifting capacity of said spar buoy.

3. The system as recited in claim 1 further comprising third sheave means disposed below said second sheave means for ensuring that the change in the length of cable wrapped around the first sheave is approximately equal and opposite to change in the length of the cable wrapped around the second sheave when said frame means rotates on said first axis so that there is no vertical motion of the payload.

4. The system as recited in claim 1 wherein said spar buoy includes:

fixed ballast means disposed at the bottom of said base section to provide righting moment to stabilize said spar buoy;

a fixed buoyancy compartment for supporting the weight of the spar buoy; and a variable ballast chamber in the base section, said variable ballast chamber adapted to be watered or dewatered to provide a variable lifting capacity for said spar buoy.

5. The system as recited in claim 4 wherein said variable ballast chamber is a hollow chamber in the lower portion of said base section, the underside of said chamber being open for receiving the water; and further comprising:

means for directing air under pressure into and out of the top of said chamber, the air pressure being increased to cause air to flow into said chamber and force water out to increase the lifting capacity of said spar buoy, and being decreased to allow the water pressure to force air out to decrease the lifting capacity of said spar buoy.

6. The system as recited in claim 5 further comprising means for disengaging said yoke from said spar buoy and securing the lifting cable to the spar at its instantaneous position.

7. The system as recited in claim 6 wherein said means for disengaging and securing comprise:

latch means for coupling said yoke to the top of said spar buoy;

means for disengaging said latch means to release said yoke from said spar buoy;

gripper means disposed in said longitudinal channel for securing the lifting cable at its instantaneous position when said yoke is disengaged from said spar buoy; and means for actuating said gripper means.

8. The system as recited in claims 2 or 4 wherein said frame means comprises:

two rigid arms rigidly joined together in an apex at the outboard end, the other ends of said arms being hinged about the first axis of rotation to allow said frame means to rotate about the first axis.

9. The system as recited in claim 8 wherein said variable ballast chamber is a hollow chamber in the lower portion of said base section, the underside of said chamber being open for receiving the water, and further comprising:

means for directing air under pressure into and out of the top of said chamber, the air pressure being increased to cause air to flow into said chamber and force water out to increase the lifting capacity of said spar buoy, and being decreased to allow the water pressure to force air out to decrease the lifting capacity of said spar buoy.

10. The system as recited in claim 9 further comprising:

means for disengaging said yoke from said spar buoy and securing the lifting cable to the spar at its instantaneous position.

11. The system as recited in claim 10 wherein said means for disengaging and securing comprise:

latch means for coupling said yoke to the top of said spar buoy;

means for disengaging said latch means to release said yoke from said spar buoy;

gripper means disposed in said longitudinal channel for securing the lifting cable at its instantaneous position when said yoke is disengaged from said spar buoy; and means for actuating said gripper means.

12. The system as recited in claim 11 wherein said gripper means comprise a plurality of toothed cable grippers, each gripper rotatable about an axis normal to the longitudinal channel and held clear of said cable by spring means when unactuated, and wherein said means for actuating said gripper means comprises a weighted collar, said collar falling to rotate said grippers to engage the cable when said yoke is disengaged from said spar buoy.

13. The system as recited in claim 10 wherein said spar buoy further includes a flexural strain in relief disposed at the lower end of said longitudinal channel.

14. The system as recited in claim 8 further comprising means for deck-handling the system using topping lift techniques.

15. The system as recited in claim 14 wherein said means for deck handling comprises:

means for supporting topping lift lines on the platform;

topping lift lines coupled between said means for supporting and said yoke means;

winch means for taking in or letting out said topping lift lines thereby causing said rigid frame to rotate about the first axis to and from a storage position.

16. The system as recited in claim 15 further comprising:

means for supporting said rigid frame in a substantially upright storage position, said frame being rotated to the substantially upright position by use of said topping lift lines.

17. The system as recited in claim 16 wherein said means for supporting said rigid frame comprises piston means.

* * * * *